US006896482B2

(12) United States Patent
Parry

(10) Patent No.: US 6,896,482 B2
(45) Date of Patent: May 24, 2005

(54) EXPANDING SEALING STRIPS FOR STEAM TURBINES

(75) Inventor: William Thomas Parry, Scotia, NY (US)

(73) Assignee: General Electric Company, Schenectady, NY (US)

( * ) Notice: Subject to any disclaimer, the term of this patent is extended or adjusted under 35 U.S.C. 154(b) by 47 days.

(21) Appl. No.: 10/654,319

(22) Filed: Sep. 3, 2003

(65) Prior Publication Data

US 2005/0047909 A1 Mar. 3, 2005

(51) Int. Cl.[7] ..... F01D 25/26

(52) U.S. Cl. ..... 415/136; 415/173.1; 415/173.5; 415/173.6; 415/214.1; 415/229; 415/231; 277/412

(58) Field of Search ..... 415/173.1, 173.2, 415/173.3, 173.5, 173.6, 173.7, 136, 137, 214.1, 229, 230, 231; 277/412, 418, 421

(56) References Cited

U.S. PATENT DOCUMENTS

| | | | | |
|---|---|---|---|---|
| 5,133,640 A | | 7/1992 | Groenendaal, Jr. | |
| 5,599,026 A | | 2/1997 | Sanders et al. | |
| 5,601,403 A | | 2/1997 | Galbraith et al. | |
| 5,653,579 A | | 8/1997 | Glezer et al. | |
| 5,775,873 A | | 7/1998 | Dalton et al. | |
| 5,833,244 A | | 11/1998 | Salt et al. | |
| 6,036,437 A | | 3/2000 | Wolfe et al. | |
| 6,065,754 A | * | 5/2000 | Cromer et al. | 277/412 |
| 6,131,910 A | | 10/2000 | Bagapalli et al. | |
| 6,290,232 B1 | | 9/2001 | Reluzco | |
| 6,318,728 B1 | | 11/2001 | Addis et al. | |
| 6,331,006 B1 | | 12/2001 | Baily et al. | |
| 6,340,286 B1 | | 1/2002 | Aksit et al. | |
| 6,352,405 B1 | | 3/2002 | Tomko | |
| 6,394,459 B1 | | 5/2002 | Florin | |
| 6,406,027 B1 | | 6/2002 | Aksit et al. | |
| 6,435,514 B1 | | 8/2002 | Aksit et al. | |
| 6,439,844 B1 | | 8/2002 | Turnquist et al. | |
| 6,454,270 B1 | | 9/2002 | Chi et al. | |
| 6,776,577 B1 | * | 8/2004 | Chu et al. | 415/241.1 |

FOREIGN PATENT DOCUMENTS

| | | |
|---|---|---|
| CH | 218 970 A | 1/1942 |
| RU | 2210673 C2 | 8/2003 |
| WO | WO 01/57420 A1 | 8/2001 |
| WO | WO 01/76348 A2 | 10/2001 |

OTHER PUBLICATIONS

International Search Report, dated Jan. 4, 2005, Application No. PCT/US2004/028773, 5 pages.

* cited by examiner

*Primary Examiner*—Edward K. Look
*Assistant Examiner*—Dwayne J. White
(74) *Attorney, Agent, or Firm*—Armstrong Teasdale LLP

(57) ABSTRACT

A turbine includes, in an exemplary embodiment, an outer housing, a turbine shaft rotatably supported in the outer housing, and a plurality of turbine stages located along the turbine shaft. Each turbine stage includes a diaphragm attached to the casing, a rotor having a plurality of buckets and a bucket cover fixedly attached to the turbine shaft, and a packing ring mounted in a first circumferentially extending groove in said diaphragm. The packing ring includes a seal shroud and a sealing means and is positioned adjacent the turbine shaft. The seal shroud is fabricated from a first material having a first coefficient of expansion, and the is diaphragm fabricated from a second material having a second coefficient of expansion. The first and second materials are selected so that at a first temperature a gap between the turbine shaft and the diaphragm is larger than at a second higher temperature.

20 Claims, 3 Drawing Sheets

EXPANDING SEALING STRIPS FOR STEAM TURBINES

BACKGROUND OF THE INVENTION

The present invention relates generally to rotary machines, such as steam and gas turbines, and, more particularly, relates to a rotary machine having a seal assembly for controlling clearance between tips of rotating rotor blades and a stationary outer casing of the rotary machine.

Steam and gas turbines are used, among other purposes, to power electric generators. A steam turbine has a steam path which typically includes, in serial-flow relationship, a steam inlet, a turbine, and a steam outlet. A gas turbine has a gas path which typically includes, in serial-flow relationship, an air intake (or inlet), a compressor, a combustor, a turbine, and a gas outlet (or exhaust nozzle). Compressor and turbine sections include at least one circumferential row of rotating blades. The free ends or tips of the rotating blades are surrounded by a stator casing.

The efficiency of the turbine depends in part on the radial clearance or gap between the rotor blade tips and the surrounding casing and the clearance between the rotor and the diaphragm packings. If the clearance is too large, more of the steam or gas flow will leak through the gap between the rotor blade tips and the surrounding casing or between the diaphragm and the rotor, decreasing the turbine's efficiency. If the clearance is too small, the rotor blade tips can strike the surrounding casing during certain turbine operating conditions. Gas or steam leakage, either out of the gas or steam path or into the gas or steam path, from an area of higher pressure to an area of lower pressure, is generally undesirable. For example, gas-path leakage in the turbine or compressor area of a gas turbine, between the rotor of the turbine or compressor and the circumferentially surrounding turbine or compressor casing, will lower the efficiency of the gas turbine leading to increased fuel costs. Also, steam-path leakage in the turbine area of a steam turbine, between the rotor of the turbine and the circumferentially surrounding casing, will lower the efficiency of the steam turbine leading to increased fuel costs.

It is known that the clearance changes during periods of acceleration or deceleration due to changing centrifugal force on the blade tips and due to relative thermal growth between the rotating rotor and stationary casing. During periods of differential centrifugal and thermal growth of the rotor and casing the clearance changes can result in severe rubbing of the moving blade tips against the stationary casing. This increase in blade tip clearance results in efficiency loss.

Clearance control devices, such as rigid abradable shrouds, have been used in the past to accommodate rotor-to-casing clearance change. However, none are believed to represent an optimum design for controlling such clearance. Also, positive pressure packings have been used that include movable packings that permit the packings to be in a retracted position during startup and in an extended position during steady state operation of the turbine. However, the moving parts can stick during operation preventing the packings from moving between the extended and retracted positions.

BRIEF DESCRIPTION OF THE INVENTION

In one aspect a turbine is provided that includes an outer housing, a turbine shaft rotatably supported in the outer housing, and a plurality of turbine stages located along the turbine shaft and contained within the outer housing. Each turbine stage includes a diaphragm attached to the casing, a rotor fixedly attached to the turbine shaft, and a packing ring mounted in a first circumferentially extending groove in said diaphragm. The rotor includes a plurality of buckets and a bucket cover. The packing ring includes a seal shroud and a sealing means. The packing ring is positioned adjacent the turbine shaft to provide a seal in a gap between said turbine shaft and the diaphragm. The seal shroud is fabricated from a first material having a first coefficient of expansion, and the is diaphragm fabricated from a second material having a second coefficient of expansion. The first and second materials are selected so that at a first temperature the gap between the turbine shaft and the diaphragm is larger than at a second higher temperature.

In another aspect a diaphragm for a steam turbine is provided. The turbine includes a rotatable shall and at least one rotor fixedly attached to the shaft, with the rotor including a plurality of buckets and a bucket cover. The diaphragm includes a plurality of nozzles and a packing ring mounted in a first circumferentially extending groove in the diaphragm. The packing ring includes a seal shroud and a sealing means, with the packing ring configured to be positioned adjacent the turbine shaft to provide a seal in a gap between the turbine shaft and said diaphragm. The seal shroud is fabricated from a first material having a first coefficient of expansion, and the diaphragm is fabricated from a second material having a second coefficient of expansion. The first and second materials are selected so that at a first temperature the gap between the turbine shaft and the diaphragm is larger than at a second higher temperature.

DETAILED DESCRIPTION OF THE INVENTION

A steam turbine diaphragm and attached packing ring and spill-strip seal ring are described below in detail. The diaphragm, packing ring, and spill-strip seal ring are fabricated from materials that have different coefficients of expansion which permits controlled thermal growth of these various parts. This permits a variation of clearance between moving and non-moving parts in the turbine so that during cold starts, parts can be relatively "far" apart, but at normal steady state operation the clearances automatically reduce to a minimum value to prevent steam leakage and to increase turbine efficiency.

Figure 1:
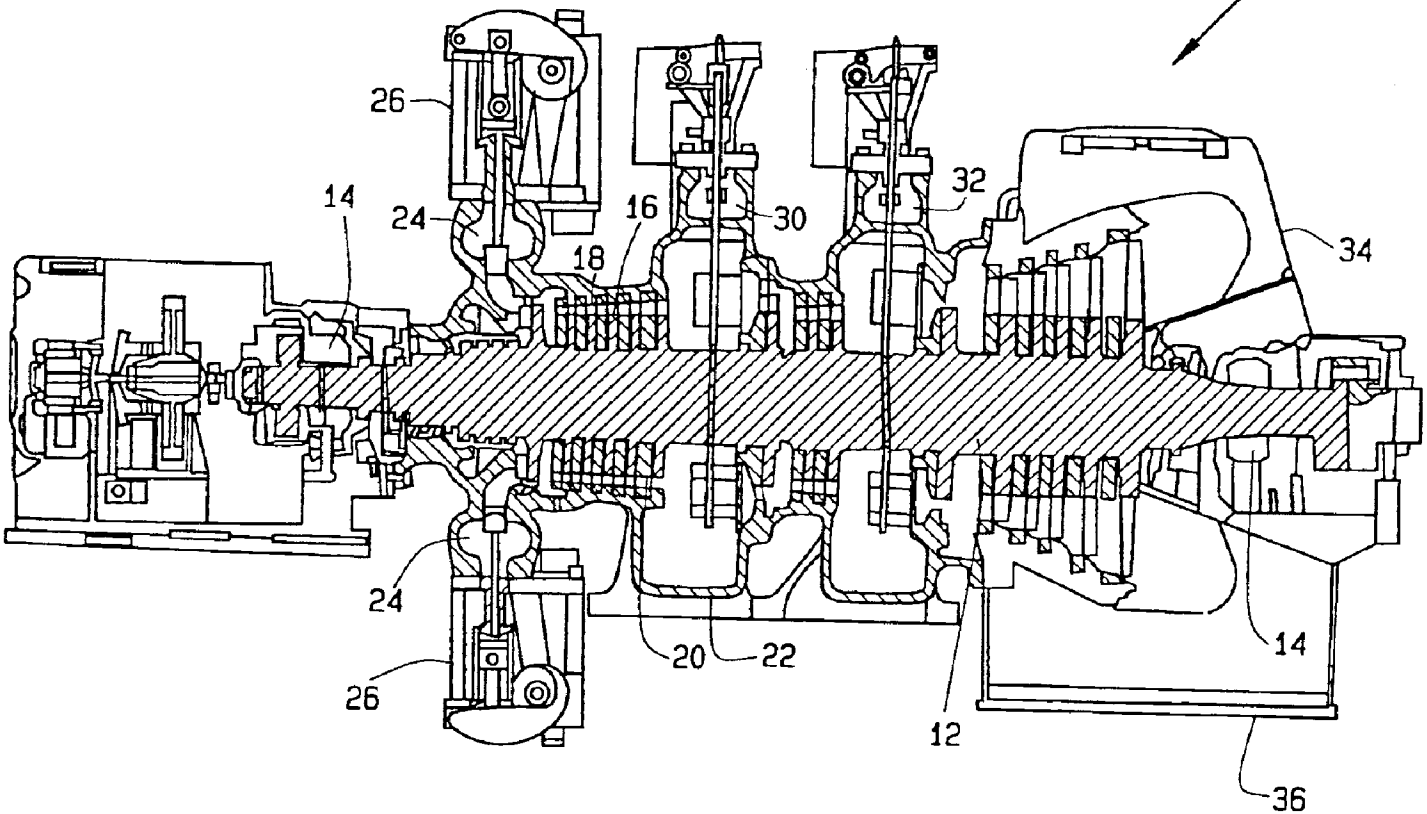
FIG. 1 is sectional schematic view of a steam turbine.

Referring to the drawings, FIG. 1 is a sectional schematic view of a steam turbine 10. Steam turbine 10 includes a shaft 12 passing through turbine 10 and supported at each end by bearing supports 14. A plurality of turbine blade stages 16 are connected to shaft 12. Between turbine blade stages 16 there is positioned a plurality of nonrotating turbine nozzles 18. Turbine blades or buckets 16 are connected to turbine shaft 12 while turbine nozzles 18 are connected to support members or nozzle diaphragms 20 attached to a housing or shell 22 surrounding turbine blades 16 and nozzles 18. Steam inlet ports 24 connect to a source of high temperature steam and direct the steam into turbine 10. Main steam control valves 26 control the flow of steam into turbine 10. Steam is directed through nozzles 18 to impact blades 16 causing blades 16 to rotate along with turbine shaft 12. Some of the steam is admitted into extraction chambers 30 and 32 and a predetermined amount of steam is intentionally piped off to various feedwater heaters (not shown). After the remaining steam passes through all of the turbine blades, it exits through steam exhaust casing 34 and exhaust outlet 36 and is directed back to a condenser (not shown) and then to a reheater and/or boiler (not shown) to be reconverted into steam.

Figure 2:
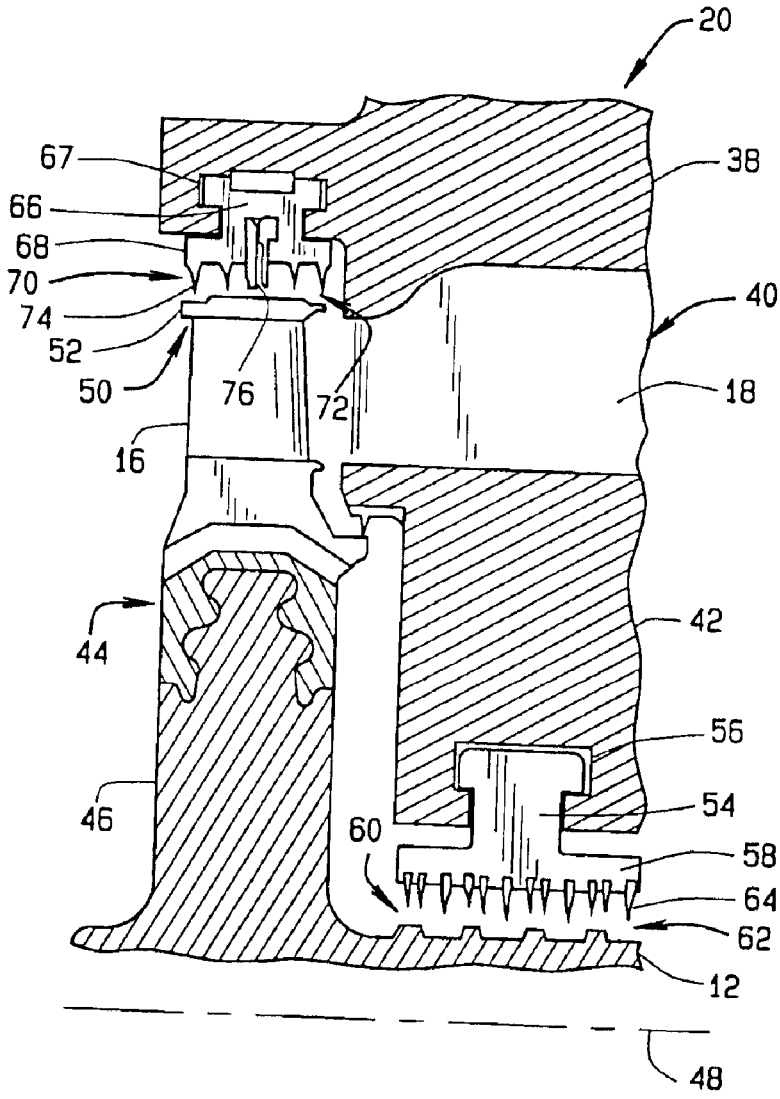
FIG. 2 is a sectional schematic view of one embodiment of a diaphragm of the steam turbine shown in FIG. 1 at a first temperature.
Figure 3:
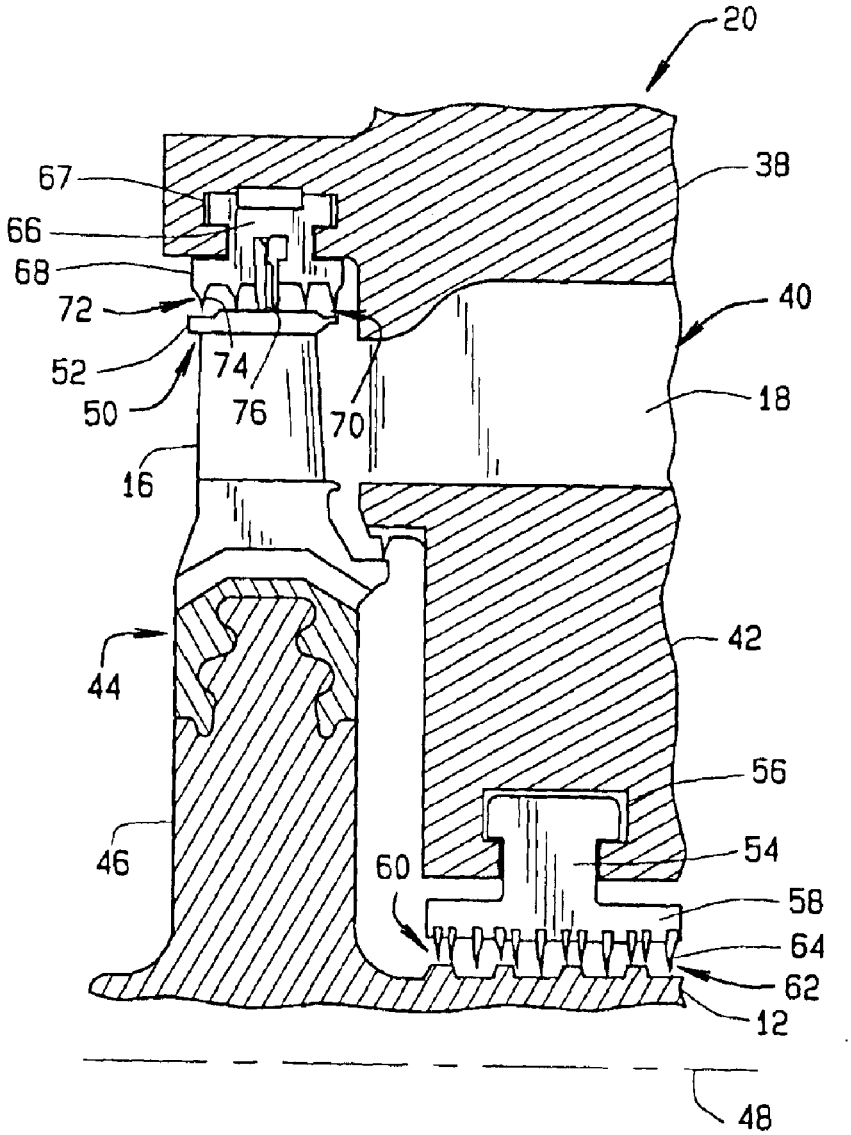
FIG. 3 is a sectional schematic view of one embodiment of a diaphragm of the steam turbine shown in FIG. 1 at a second higher temperature.

FIG. 2 is a sectional schematic view of one embodiment of diaphragm 20 of steam turbine 10 at a first temperature and FIG. 3 is a sectional schematic view of diaphragm 20 at a second higher temperature. Referring to FIGS. 2 and 3, diaphragm 20 includes an outer ring portion 38 coupled to outer turbine housing 22 (shown in FIG. 1), a ring 40 of steam directing nozzles 18 supported within outer ring portion 38, and an inner ring portion 42 contained within nozzle ring 40. Turbine buckets 16 are secured at their inner ends 44 to turbine wheels 46 extending from turbine shaft 12 rotatable about an axis 48. The radial outer ends 50 of buckets 16 include bucket covers 52 which rotate with buckets 16. In one embodiment, a cover 52 is positioned on radial outer end 50 of each bucket 16 and in alternate embodiments on outer ends 50 of two or more buckets 16 in the form of a band so as to permit adjacent buckets 16 to be coupled to a common cover or band 52.

A packing ring 54 is mounted in a circumferentially extending groove 56 in diaphragm inner ring portion 42. Packing ring 54 includes a seal shroud 58 and a sealing means 60. Packing ring 54 is positioned adjacent turbine shaft 12 to provide a seal in a gap 62 between turbine shaft 12 and diaphragm inner ring portion 42. Packing ring sealing means 60 includes a plurality of axially spaced labyrinth seal teeth 64 extending from seal shroud 58. Packing sealing means 60 can also include a brush seal (not shown) or a combination of axially spaced labyrinth seal teeth 64 and a brush seal.

Seal shroud 58 is fabricated from a first material having a first coefficient of expansion, and diaphragm inner ring portion 42 is fabricated from a second material having a second coefficient of expansion. The first and second materials are selected so that at a first temperature, for example, the start-up temperature of steam turbine 10, gap 62 between turbine shaft 12 and diaphragm 20 is larger than at a second higher temperature, for example, the operating temperature of steam turbine 10. FIG. 2 shows gap 62 at the start-up temperature of turbine 10 and FIG. 3 shows gap 62 at the operating temperature of turbine 10. As shown in FIG. 3, gap 62 is small enough to permit seal means 60 to seal the flow of steam through gap 62. Some non-limiting examples of suitable materials for use as the first and second materials described above are listed in Table I.

TABLE I

| Material | Thermal Expansion Coefficient at 500 F. ($10^{-6}$ in/(in- ° F.)) |
|---|---|
| 12 Cr, 17 Cr, 27 Cr | 5.92 |
| Gray cast iron | 6.28 |
| 5 Cr Mo through 9 Cr Mo | 6.50 |
| Ductile Iron | 6.85 |
| 3.5 Nickel | 6.93 |
| CrMoV | 7.02 |
| Ni—Cr—Fe | 7.80 |

TABLE I-continued

| Material | Thermal Expansion Coefficient at 500 F. ($10^{-6}$ in/(in- ° F.)) |
|---|---|
| Monel 67 Ni, 30 Cu | 8.40 |
| Ni—Fe—Cr | 8.90 |
| 25 Cr, 20 Ni | 8.93 |
| Austenitic stainless steels 18 Cr, 8 Ni | 9.70 |
| Bronze | 10.32 |
| Brass | 10.47 |
| Aluminum | 13.90 |

For example, when comparing the thermal expansions of a high chrome content steel (12Cr, 17CR, 27Cr) with the thermal expansions of a CrMoV steel typically used in a turbine, the difference in thermal expansion coefficients is $1.10*10^{-6}$ in/(in –° F.). For a 22 inch packing diameter rotor made from CrMoV steel, the increase in diameter for each 100° F. can be approximated by $100*7.02*10^{-6}*22=0.0154$ inches (391.1 $\mu$m). Changing the rotor material to a high chrome content steel (12Cr, 17CR, 27Cr), the increase in diameter for each 100° F. can be approximated by $100*5.92*10^{-6}*22=0.0130$ inches (330.1 $\mu$m). Therefore, for each 100° F. of temperature rise, the radial clearance is changed by about 0.0024 inches (61.0 $\mu$m).

A spill-strip seal ring 66 is mounted in a second circumferentially extending groove 67 in said diaphragm outer ring portion 38. Spill-strip seal ring 66 includes a seal shroud 68 and a sealing means 70. Spill-strip seal ring 66 is positioned adjacent bucket cover 52 to provide a seal in a gap 72 between bucket cover 52 and diaphragm outer ring portion 38. Spill-strip seal ring sealing means 70 includes a plurality of axially spaced labyrinth seal teeth 74 extending from seal shroud 68 and a brush seal 76. Packing sealing means 70, in other embodiments include brush seals 76 alone or axially spaced labyrinth seal teeth 74 alone.

Seal shroud 68 of spill-strip seal ring 66 is fabricated from a third material having a third coefficient of expansion. The third material selected so that at a first temperature, for example, the start-up temperature of steam turbine 10, gap 72 between bucket cover 52 and diaphragm 20 is larger than at a second higher temperature, for example, the operating temperature of steam turbine 10. FIG. 2 shows gap 72 at the start-up temperature of turbine 10 and FIG. 3 shows gap 70 at the operating temperature of turbine 10. As shown in FIG. 3, gap 72 is small enough to permit seal means 70 to seal the flow of steam through gap 72. Some non-limiting examples of suitable materials for use as the third material are listed above in Table I.

It should be understood that various materials with various coefficients of expansion can be used. One skilled in the art would appreciate that the coefficient of expansion of diaphragm 20 can be greater than or less than the coefficient of expansion of either packing ring 54 and spill-strip seal ring 66 and that the coefficient of expansion of packing ring 54 can be equal to, larger than, or smaller than the coefficient of expansion of spill-strip seal ring 66.

The above described diaphragm 20 permits built-in clearances that are large enough to prevent the rubbing of turbine parts during start-up conditions. The above described diaphragm 20 also permits the "large" clearances to reduce due to controlled thermal growth of diaphragm 20, packing ring 54, and spill-strip seal ring 66 to prevent steam leakage. The reduced steam leakage around buckets 15 increases efficiency of turbine 10.

While the invention has been described in terms of various specific embodiments, those skilled in the art will recognize that the invention can be practiced with modification within the spirit and scope of the claims.

What is claimed is:

1. A steam turbine comprising:

an outer housing;

a turbine shaft rotatably supported in said outer housing; and a plurality of turbine stages located along said turbine shaft and contained within said outer housing, each said turbine stage comprising:

a diaphragm attached to the casing, said diaphragm comprising a plurality of nozzles;

a rotor fixedly attached to said turbine shaft, said rotor comprising a plurality of buckets and a bucket cover; and a packing ring mounted in a first circumferentially extending groove in said diaphragm, said packing ring comprising a seal shroud and a sealing means, said packing ring positioned adjacent said turbine shaft to provide a seal in a gap between said turbine shaft and said diaphragm;

said seal shroud fabricated from a first material having a first coefficient of expansion, said diaphragm fabricated from a second material having a second coefficient of expansion, said first and second materials selected so that at a first temperature said gap between said turbine shaft and said diaphragm is larger than at a second higher temperature.

2. A turbine in accordance with claim 1 further comprising a spill-strip seal ring mounted in a second circumferentially extending groove in said diaphragm, said spill-strip seal ring comprising a seal shroud and a sealing means, said spill-strip seal ring positioned adjacent said bucket cover to provide a seal in a gap between said bucket cover and said diaphragm;

said seal shroud of said spill-strip seal ring fabricated from a third material having a third coefficient of expansion, said third material selected so that at a first temperature said gap between said bucket cover and said diaphragm is larger than at a second higher temperature.

3. A turbine in accordance with claim 1 wherein said packing ring sealing means comprises at least one of a plurality of seal teeth and a brush seal.

4. A turbine in accordance with claim 2 wherein said spill-strip seal ring sealing means comprises at least one of a plurality of seal teeth and a brush seal.

5. A turbine in accordance with claim 1 wherein said coefficient of expansion of said second material is larger than said coefficient of expansion of said first material.

6. A turbine in accordance with claim 2 wherein said coefficient of expansion of said second material is larger than said coefficient of expansion of said third material.

7. A turbine in accordance with claim 6 wherein said coefficient of expansion of said first material is larger equal to said coefficient of expansion of said third material.

8. A turbine in accordance with claim 1 wherein said coefficient of expansion of said second material is less than said coefficient of expansion of said first material.

9. A turbine in accordance with claim 2 wherein said coefficient of expansion of said second material is less than said coefficient of expansion of said third material.

10. A turbine in accordance with claim 9 wherein said coefficient of expansion of said first material is larger equal to said coefficient of expansion of said third material.

11. A diaphragm for a steam turbine, the turbine comprising a rotatable shaft and at least one rotor fixedly attached to the shaft, the rotor comprising a plurality of buckets and a bucket cover, said diaphragm comprising:

a plurality of nozzles; and a packing ring mounted in a first circumferentially extending groove in said diaphragm, said packing ring comprising a seal shroud and a sealing means, said packing ring configured to be positioned adjacent the turbine shaft to provide a seal in a gap between the turbine shaft and said diaphragm;

said seal shroud fabricated from a first material having a first coefficient of expansion, said diaphragm fabricated from a second material having a second coefficient of expansion, said first and second materials selected so that at a first temperature the gap between the turbine shaft and said diaphragm is larger than at a second higher temperature.

12. A diaphragm in accordance with claim 11 further comprising a spill-strip seal ring mounted in a second circumferentially extending groove in said diaphragm, said spill-strip seal ring comprising a seal shroud and a sealing means, said spill-strip seal ring configured to be positioned adjacent the bucket cover to provide a seal in a gap between the bucket cover and said diaphragm;

said seal shroud of said spill-strip seal ring fabricated from a third material having a third coefficient of expansion, said third material selected so that at a first temperature the gap between the bucket cover and said diaphragm is larger than at a second higher temperature.

13. A diaphragm in accordance with claim 11 wherein said packing ring sealing means comprises at least one of a plurality of seal teeth and a brush seal.

14. A diaphragm in accordance with claim 12 wherein said spill-strip seal ring sealing means comprises at least one of a plurality of seal teeth and a brush seal.

15. A diaphragm in accordance with claim 11 wherein said coefficient of expansion of said second material is larger than said coefficient of expansion of said first material.

16. A diaphragm in accordance with claim 12 wherein said coefficient of expansion of said second material is larger than said coefficient of expansion of said third material.

17. A diaphragm in accordance with claim 16 wherein said coefficient of expansion of said first material is larger equal to said coefficient of expansion of said third material.

18. A diaphragm in accordance with claim 11 wherein said coefficient of expansion of said second material is less than said coefficient of expansion of said first material.

19. A diaphragm in accordance with claim 12 wherein said coefficient of expansion of said second material is less than said coefficient of expansion of said third material.

20. A diaphragm in accordance with claim 19 wherein said coefficient of expansion of said first material is larger equal to said coefficient of expansion of said third material.

* * * * *